US009689172B1

(12) United States Patent
Genova

(10) Patent No.: US 9,689,172 B1
(45) Date of Patent: Jun. 27, 2017

(54) MOVEMENT ASSISTANCE DEVICE FOR A SPA COVER

(71) Applicant: Michael C. Genova, Spokane, WA (US)

(72) Inventor: Michael C. Genova, Spokane, WA (US)

(73) Assignee: Leisure Concepts, Inc., Spokane, WA (US)

( * ) Notice: Subject to any disclaimer, the term of this patent is extended or adjusted under 35 U.S.C. 154(b) by 0 days.

(21) Appl. No.: 15/090,808

(22) Filed: Apr. 5, 2016

(51) Int. Cl.
*E04H 4/08* (2006.01)
*A61H 33/00* (2006.01)

(52) U.S. Cl.
CPC ..... *E04H 4/084* (2013.01); *A61H 33/60* (2013.01)

(58) Field of Classification Search
CPC ..... E04H 4/084
See application file for complete search history.

(56) References Cited

U.S. PATENT DOCUMENTS

| | | | | |
|---|---|---|---|---|
| 2,545,959 | A | 3/1951 | King | |
| 3,567,062 | A | 3/1971 | Reed | |
| 4,853,985 | A | 8/1989 | Perry | |
| 4,857,374 | A | 8/1989 | Perry | |
| 4,991,238 | A | 2/1991 | Forrest | |
| 5,048,153 | A | 9/1991 | Wall | |
| 5,131,102 | A | 7/1992 | Salley | |
| 5,248,057 | A | 9/1993 | Taylor | |
| 5,517,703 | A | 5/1996 | Ouelette | |
| 5,566,403 | A | 10/1996 | Black | |
| 5,584,081 | A | 12/1996 | Ouelette | |
| 5,634,218 | A | 6/1997 | Ouelette | |
| D384,479 | S | 9/1997 | Ouelette | |
| 5,689,841 | A | 11/1997 | Black | |
| 5,819,332 | A | 10/1998 | Perry | |
| 5,950,252 | A | 9/1999 | Fettes | |
| 5,974,599 | A | 11/1999 | Tudor | |
| 6,000,071 | A | 12/1999 | Fettes | |
| 6,000,072 | A | 12/1999 | LaHay | |
| 6,032,305 | A | 3/2000 | Tedrick | |
| 6,158,063 | A | 12/2000 | Tudor | |
| 7,155,756 | B1 * | 1/2007 | Helder | E04H 4/084 4/498 |
| 8,813,275 | B2 | 8/2014 | Genova | |
| 2009/0126097 | A1 * | 5/2009 | Kanetis | E04H 4/084 4/503 |

* cited by examiner

*Primary Examiner* — Janie Loeppke
(74) *Attorney, Agent, or Firm* — Randall Danskin P.S.

(57) ABSTRACT

A movement assistance device for a spa cover is described and which includes a moveable spa cover portion, and a pair of pneumatic cylinders which cooperate with a housing mounted on one of the spa cover portions, and which further assists in the movement of one of the spa cover portions relative to the other spa cover portion, and a third pneumatic cylinder is provided and which allows movement of each of the respective spa cover portions to a non-occluding position relative to the spa so as to allow use of the spa.

20 Claims, 11 Drawing Sheets

MOVEMENT ASSISTANCE DEVICE FOR A SPA COVER

TECHNICAL HELD

The present invention relates to a movement assistance device for a spa cover, and more specifically to a device which is operable to permit a user to conveniently and easily move portions of a spa cover, one relative to the other, in a manner not possible heretofore.

BACKGROUND OF THE INVENTION

Covers for spas or so-called "hot tubs" have been utilized for decades. These spa covers are often employed in cooler climates to minimize the escape of heat energy from the spa. Further they are often employed to cover the spa to prevent unauthorized access to the spa, or to prevent debris such as dust, leaves, insects and the like from being deposited within the spa. Heretofore, spa covers have had two portions which have been usually fabricated from lightweight, insulative sheets, and which have been typically enclosed in a flexible, synthetic, fluid impermeable sheet or envelope. The two portions are typically joined together by a continuous hinge. In most prior art spa covers the hinge is formed by a seam of flexible, typically fluid impermeable material which bridges between the two halves or portions. It has been a common practice to remove such prior art spa covers by swinging or moving one-half of the spa cover onto the remaining other half, and then lifting both of the halves off of the top of the spa in order to expose the spa for use. As is described in various detail in many prior art references, this task of removing the spa cover has sometimes been difficult because of the awkwardness of the spa cover construction, and further due to the weight of these spa covers as the same spa covers have become heavier, over time, due to the absorption of water which is occasioned by their proximity to the underlying heated spa water, or because water is absorbed from the ambient environment. In my U.S. patent application Ser. No. 14/526,825 which was filed on Oct. 29, 2004, I describe a spa cover combination and wherein a ridged, spa cover is illustrated and which has individual portions which are operable to fold onto themselves and then be removed separately from the underlying spa so as to assist in the opening of the spa (FIG. 2). This particular spa cover design as seen in my pending application represents an improvement over my spa cover as seen in U.S. Pat. No. 8,813,275, and which was issued on Aug. 26, 2014 (FIG. 1). This other spa cover which I designed has achieved a great deal of success, and experienced widespread market acceptance because the construction substantially prevents the absorption of water into the interior of the spa cover portions, and further this design permits a user to stand on the spa cover in order to remove unnatural accumulations of snow, leaves and other debris that might be occasioned by the use of the spa during the fall and winter seasons.

While the aforementioned spa cover designs which I have commercially introduced have achieved a great deal of commercial success, users of spas who have various medical conditions, or otherwise have reduced strength, still find some difficulty in removing the aforementioned spa covers to expose the spa for use under certain environmental conditions such as when the spa is covered with moderate amounts of snow or other conditions such as high winds exist.

A movement assistance device is described in the present patent application, and which aids and assists in the movement of a spa cover to uncover a spa in a particularly easy, and novel manner which is not shown or described in the prior art teachings. The movement assistance device as described, and claimed is easy and simple (EAS) to use, and further allows users, even with reduced strength, to readily remove a spa cover in a convenient and safe manner which was not possible, heretofore.

SUMMARY OF THE INVENTION

A first aspect of the present invention relates to a movement assistance device for a spa cover which includes a spa having a main body and which defines an upwardly facing spa opening; a spa cover having first and second portions which are hingedly mounted together, and which occlude the spa opening when positioned in a coplanar orientation relative to each other; individual lift support arms cooperating with the second portion of the spa cover, and which further have an end which is pivotally attached to the main body of the spa; a first and second pneumatic cylinder which are mounted on the first portion of the spa cover, and which individually, and mechanically cooperate with the second portion of the spa cover to assist in the movement of the first portion of the spa cover from a coplanar orientation relative to the second portion of the spa cover, and which occludes the spa opening, to an orientation where the first and second spa cover portions are located in a partially occluding position relative to the spa opening, and wherein the first and second pneumatic cylinders further assist in the return of the first portion of the spa cover back to the coplanar orientation relative to the second portion of the spa cover, and which occludes the spa opening; and a third pneumatic cylinder mounted on the lift support member and which has a reciprocally moveable ram which is mounted on the main body of the spa, and wherein the third pneumatic cylinder exerts a force which assists in the movement of the first and second portions of the spa cover from a partially occluding position relative to the spa opening, to a non-occluding position relative the spa opening, and further resists the movement of the first and second portions of the spa cover from the non-occluding position relative to the spa opening to a partially occluding position relative to the spa opening.

Another aspect of the present invention relates to a movement assistance device for a spa cover and which includes a spa having a main body, and defining an upwardly facing spa opening; a spa cover having first and second portions, and which are operable, when located in a coplanar orientation relative to each other, to substantially occlude the spa opening, and wherein the first and second spa cover portions are hingedly mounted together; a lift cross-member having opposite ends, and wherein at least a portion of the lift cross member cooperates with the second portion of the spa cover; individual lift support arms which are mounted to the opposite ends of the lift cross-member, and wherein an end of each of the lift support members is pivotally mounted to the main body of the spa; a housing having first and second members which are located in spaced relation, one relative to the other, and wherein the housing is mounted on the second portion of the spa cover, and wherein a camming engagement member is positioned between the first and second members and within the housing; a first and second pneumatic cylinder mounted on the first portion of the spa cover, and wherein the pneumatic cylinder has a reciprocally moveable ram portion which has a distal camming member, and which further cooperates with the camming engagement member, and wherein the first pneumatic cylinder exerts a force which assists in the movement of the first portion of the spa cover from a co-planar orientation relative to the second portion of the spa cover to a vertical orientation relative to the second portion of the spa cover, and further the first pneumatic cylinder resists the movement of the first portion of the spa cover from the vertical orientation relative to the second portion of the spa cover back to the co-planar orientation relative to the second portion of the spa cover, and wherein the second pneumatic cylinder resists the movement of the first portion of the spa cover from the vertical orientation relative to the second portion of the spa cover, to a juxtaposed, substantially parallel orientation relative to the second portion of the spa cover, and where the spa opening is partially non-occluded; and a third pneumatic cylinder mounted on the lift support arm and which has a reciprocally moveable ram member which is attached to the main body of the spa, and wherein the third pneumatic member exerts a force to assist in the movement of the first and second spa cover portions from a partially occluding orientation relative to the spa opening, to a non-occluding orientation relative thereto, and further resists the movement of the first and second spa cover portions from the non-occluding orientation relative to the spa opening back to a partially occluding orientation relative to the spa opening.

Yet still another aspect of the present invention relates to a movement assistance device for a spa cover which includes a spa having a main body which defines an internal cavity, and which encloses a source of water, and wherein the spa has top peripheral edge which defines a spa opening, and further which allows access to the spa by a user; a spa cover having first and second spa cover portions which are hingedly mounted together at a continuous joint, and wherein the first and second spa cover portions when oriented in a coplanar orientation relative to each other, and are further in rested relation relative to the top peripheral edge of the spa, are sized so as to occlude the spa opening defined by the top peripheral edge of the spa, and wherein each of the first and second spa cover portions have opposite peripheral edges; a lift cross-member having a main body and opposite ends, and wherein the main body of the lift cross-member is received, at least in part, within the second portion of the spa cover, and is further located adjacent, and in parallel relation relative to the continuous joint, and wherein the opposite ends of the lift cross-member extend laterally, outwardly, relative to the opposite peripheral edges of the second spa cover portion; a pair of elongated, lift support arms which are individually attached to the opposite ends of the lift cross-member, and wherein the respective lift support arms each have a proximal end which is attached to one end of the lift cross member, and a distal end which is pivotally mounted on the main body of the spa; a first and second pneumatic cylinder mounted on the opposite peripheral edges of the first spa cover portion, and wherein the respective pneumatic cylinders have a cylinder portion which is pivotally attached to the opposite peripheral edges of the first spa cover portion, and a reciprocally moveable ram portion which cooperates with the cylinder portion, and which further has a distal end which mounts a ramming member thereon, and wherein the reciprocal movement of the ram portion, in a first direction, is forcibly resisted by the action of the cylinder portion, and the reciprocal movement of the ram portion, in an opposite, second direction exerts a longitudinally, outwardly directed force; a housing mounted on each of the opposite, peripheral edges of the second spa cover portion, and wherein the housing has a first member mounted on the opposite, peripheral edges of each of the second spa cover portion, and which further has a passageway formed therein, and which is sized so as to permit the opposite ends of the lift cross-member to extend laterally, outwardly therethrough, and a second member is mounted to the first member, and which is further oriented in spaced relation relative thereto, and wherein a camming engagement member is positioned therebetween the first and second members of the housing, and the camming members of the first and second pneumatic cylinders are received within each of the housings, and moveably engage the camming engagement member when the first spa cover portion hingedly moves relative to the second spa cover portion, and wherein the first pneumatic cylinder exerts force to assist in the movement of the first spa cover portion from a coplanar orientation relative to the second spa cover portion to an orientation where the first spa cover portion is oriented substantially perpendicular relative to the second spa cover portion, and wherein the second pneumatic cylinder forcibly resists the movement of the first cover portion from a substantially vertical orientation relative to the second spa cover portion, to a horizontal, juxtaposed, and parallel orientation relative to the second spa cover portion, and wherein the second pneumatic cylinder exerts force on the first spa cover portion to assist in the movement of the first spa cover portion from the horizontal, juxtaposed, and parallel orientation relative to the second spa portion, to a vertical orientation relative to the second spa portion, and the first pneumatic cylinder resists the movement of the first spa cover portion from the vertical orientation relative to the second spa cover portion, to an orientation where the first spa cover portion is located in a coplanar orientation relative to the second spa cover portion; and a third pneumatic cylinder having a cylinder portion which is mounted on each of the lift support members, and which further has a reciprocally moveable ram portion which cooperates with the cylinder portion thereof, and which further has a distal end which is pivotally attached to the main body of the spa, and wherein the third pneumatic cylinder exerts a force to assist in the movement of the first and second spa cover portions from a horizontal, partially occluding orientation relative to the main body of the spa to a vertical, non-occluding orientation which exposes the spa opening, and wherein the third pneumatic cylinder further resists the movement of the first and second portions of the spa cover from the vertical, non-occluding orientation relative to the spa opening, to the horizontal, partially occluding orientation relative to the spa opening.

These and other aspects of the present invention will be discussed in greater detail hereafter.

DETAILED DESCRIPTION OF THE PREFERRED EMBODIMENT

This disclosure of the invention is submitted in furtherance of the constitutional purposes of the U.S. Patent Laws "to promote the progress of science and the useful arts" (Article 1, Section 8).

Figure 1:
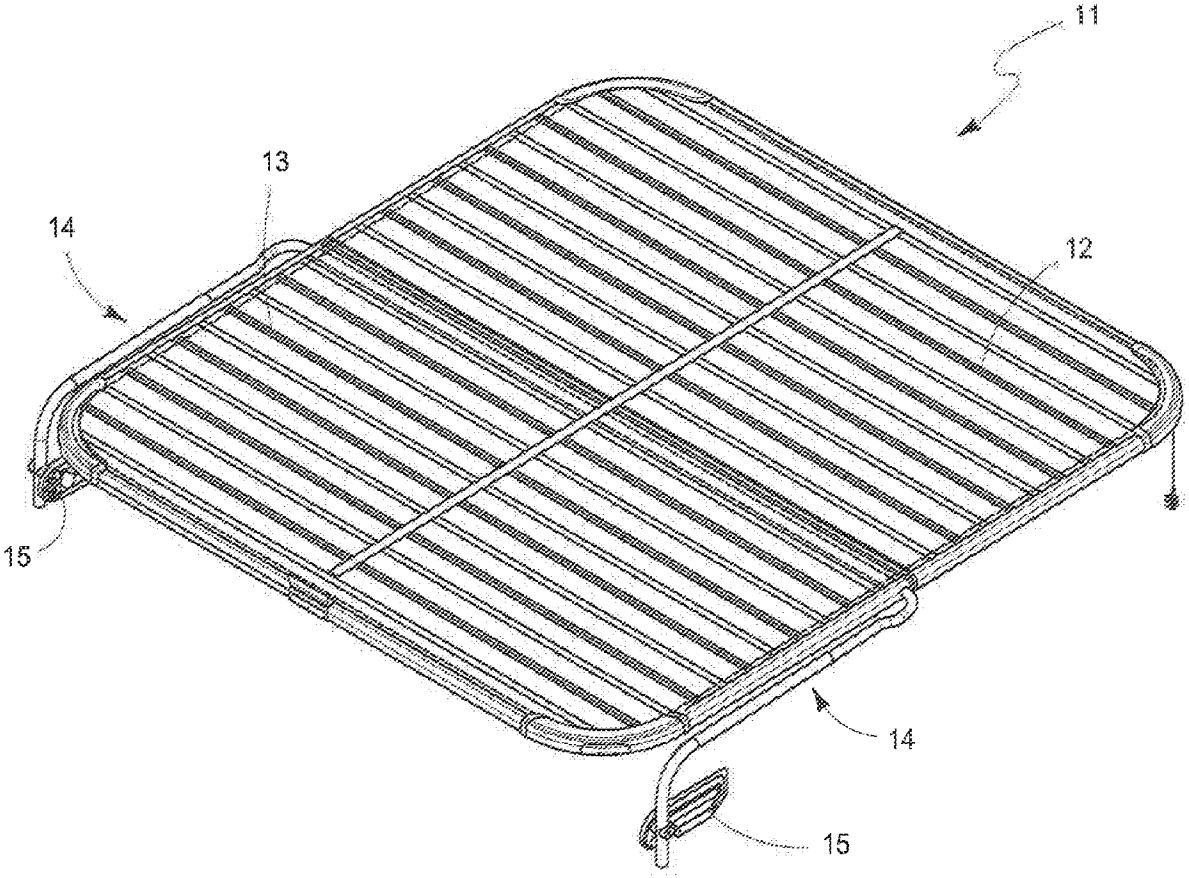
FIG. 1 PRIOR ART
FIG. 1 is a perspective, plan view of a prior art spa cover arrangement.
Figure 2:
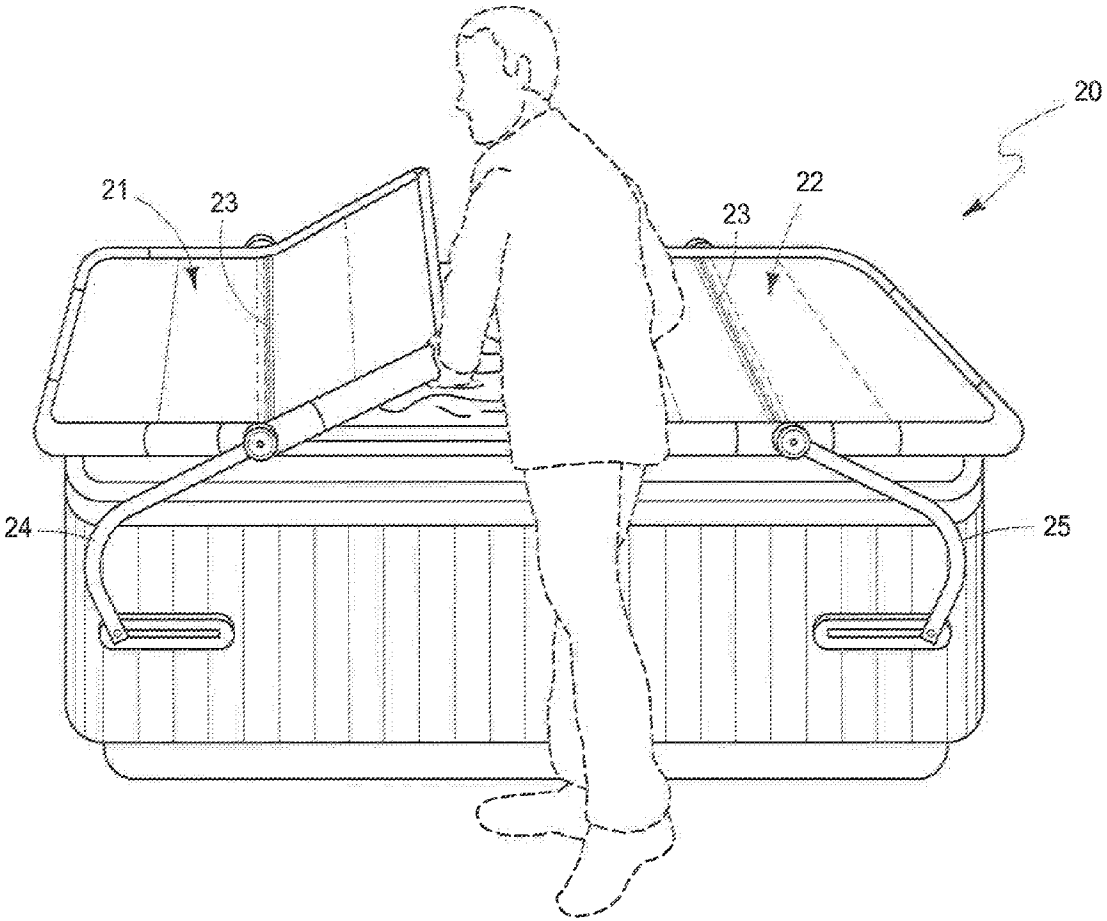
FIG. 2 PRIOR ART
FIG. 2 is a perspective, side elevation view of another prior art spa cover arrangement.
Figure 3:
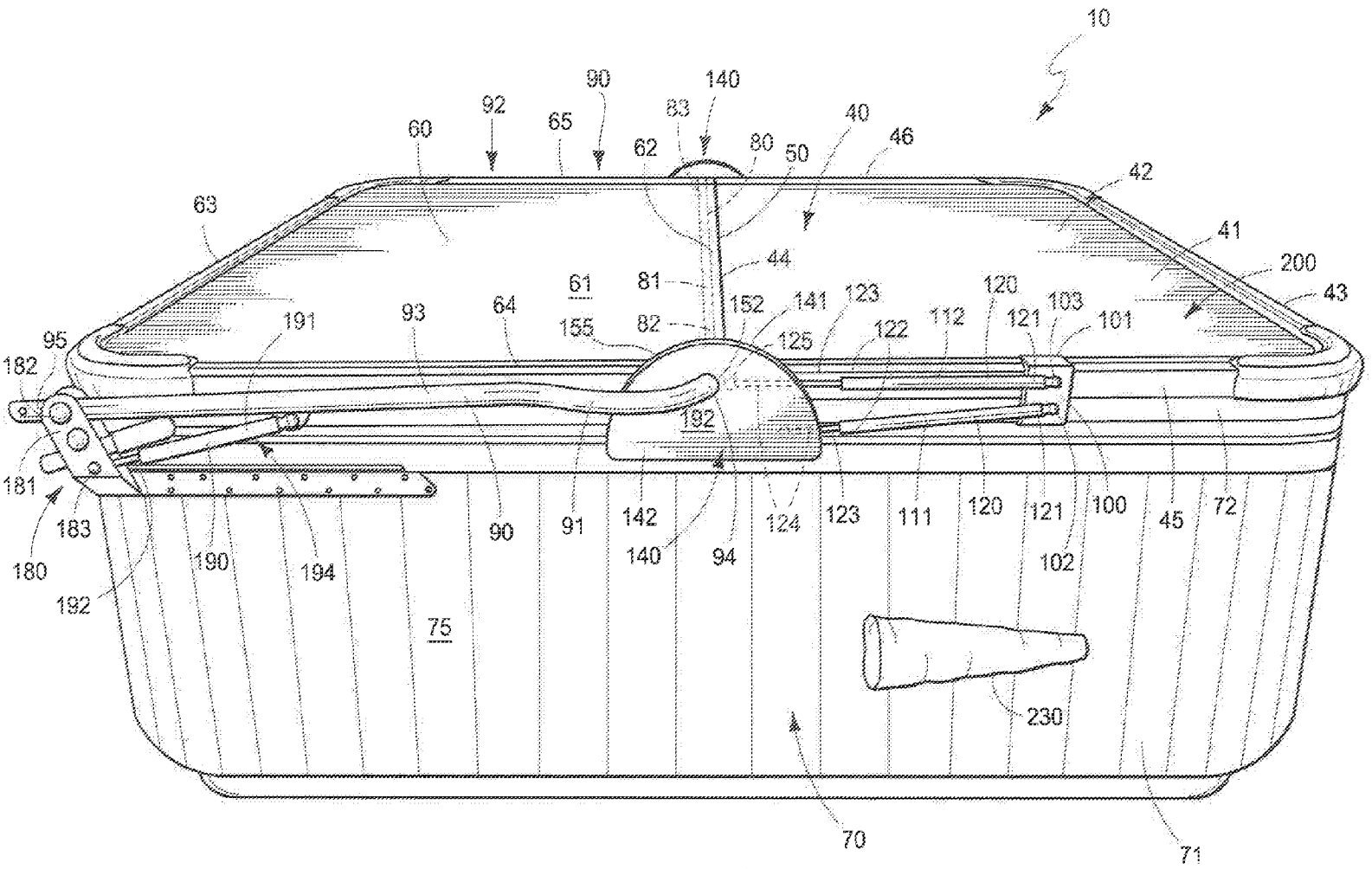
FIG. 3 is a perspective, side elevation view of a spa mounting a spa cover, and which is equipped with the movement assistance device of the present invention.

Referring now to the drawings, a movement assistance device for a spa cover, of the present invention is generally indicated in the drawings by the numeral 10 (FIG. 3). Referring now to the drawings, the prior art spa covers 1 have previously developed can be seen in FIGS. 1 and 2. The prior art spa cover as seen in U.S. Pat. No. 8,813,275 is illustrated in FIG. 1, and which is generally indicated by the numeral 11. This prior art spa cover has a first portion 12 which is hingedly connected to a second portion that is indicated by the numeral 13. A well-known spa cover lifter 14 is shown, and which further cooperates with the second portion 13 of the spa cover, and which allows a user to lift the first and second portions 12 and 13 when they are disposed or oriented in a juxtaposed substantially parallel and horizontal orientation one relative to the other. In this juxtaposed, and parallel orientation the underlying spa opening is partially occluded and the user, by exerting force on the spa cover lifter 14 is operable to move the first and second portions 12 and 13, in unison, to a substantially vertical orientation relative to the underlying spa so as to expose the entire spa for use. As earlier noted, this prior art spa cover has achieved a great deal of commercial success and has been found particularly useful by many spa owners. However, some users of spas, due to chronic medical conditions, or who otherwise have reduced strength, have found it difficult to move the first and second portions of the spa cover 12 and 13 under certain conditions such as when the spa is covered with moderate amounts of snow or other debris rests on the spa due to the geographical location where the spa is situated. The spa cover lifter 14 pivotally rotates about a mounting fixture 15 which is mounted on the main body the spa (not shown).

Referring now to FIG. 2, my second, prior art spa cover which is more fully described in U.S. application Ser. No. 14/526,825 and which was filed on Oct. 29, 2014 is shown. As discussed earlier in this patent application this second spa cover design was developed so as to address the issues raised with users of spas who might have reduced strength, and who might find it difficult to utilize the spa cover as seen in U.S. Pat. No. 8,813,275. In this regard, and by studying this drawing, it will be recognized that the second prior art spa cover 20 includes a first bi-folded spa cover portion 21, and a second bi-folded spa cover portion 22. Each of these portions have individual, continuous hinges mounted on same. As will be recognized, in this spa cover arrangement, the underlying spa is provided with first and second spa cover lifters 24 and 25, and which are coupled to, and cooperate with the first and second bi-fold portions so as to allow a user to move the first and second bi-folded spa cover portions 21 and 22 in a particularly advantageous manner so as to uncover the spa for use.

Again, and while the designs as noted in FIGS. 1 and 2 have achieved great commercial success, spa users having reduced strength, or users of spas which have larger sizes have still found, under certain conditions, that the movement of the earlier mentioned spa covers to a non-occluding position often present some difficulties.

The present invention as seen in FIG. 3 and following, and which is further indicated by the numeral 10, addresses the problems associated with users who might find it difficult to remove a spa cover either because of reduced strength, or because of ambient environmental conditions such as snow and the like resting on the spa cover.

A movement assistance device for a spa cover is generally indicated by the numeral 10, and can be seen in FIG. 3, and following. In this regard, the rigid spa cover 40 as seen in the attached drawings is similar in construction to what is seen in U.S. Pat. No. 8,813,275. In this regard the rigid spa cover 40 has a first portion 41 which is defined by a main body 42, and which further is defined by a forward peripheral edge 43; a rearward peripheral edge 44; and first and second lateral peripheral edges 45 and 46, respectively, and which are referred to, hereinafter, as the opposite peripheral edges. The rearward peripheral edge 44 is fastened to a continuous hinge or joint 50 which extends substantially along the entire length of the rearward peripheral edge 44.

The second portion of the spa cover 40, and which relates to the present invention, is generally indicated by the numeral 60, and is further mounted to the continuous hinge 50 thereby rendering the first portion 41 at least partially, rotatably moveable relative to the second portion 60. The second portion has a main body 61 which is defined by a forward peripheral edge 62 which is attached to the continuous hinge 50, and an opposite rearward peripheral edge 63. Like the first portion 41, the second portion has first and second laterally disposed peripheral edges 64 and 65. The peripheral edges 64 and 65 will hereinafter be referred to in the specification as being the opposite peripheral edges. The first and second portions 41 and 60, respectively, are sized so that when the individual portions 41 and 60 are disposed in a substantially co-planar orientation (FIG. 3), the surface area of first and second portions is large enough to substantially occlude an underlying spa opening as will be discussed in the paragraph which follows.

The movement assistance device for a spa cover 10 of the present invention is operable to be mounted, at least in part, on the spa cover 40, and is moveable relative to a spa 70 of conventional design. The spa 70 is defined by a main body 71 which has a top peripheral edge 72. The top peripheral edge defines a spa opening 73 which allows access to the internal cavity 74 of the main body. The main body is further defined by a rigid sidewall 75. The first and second portions 41 and 60 of the rigid spa cover 40 are operably moved from a co-planar substantially occluding position relative to the spa opening 73 (FIG. 3) to a substantially non-occluding position (FIG. 5D) by means of the movement assistance device for a spa cover 10, as will be described, below.

Figure 5:
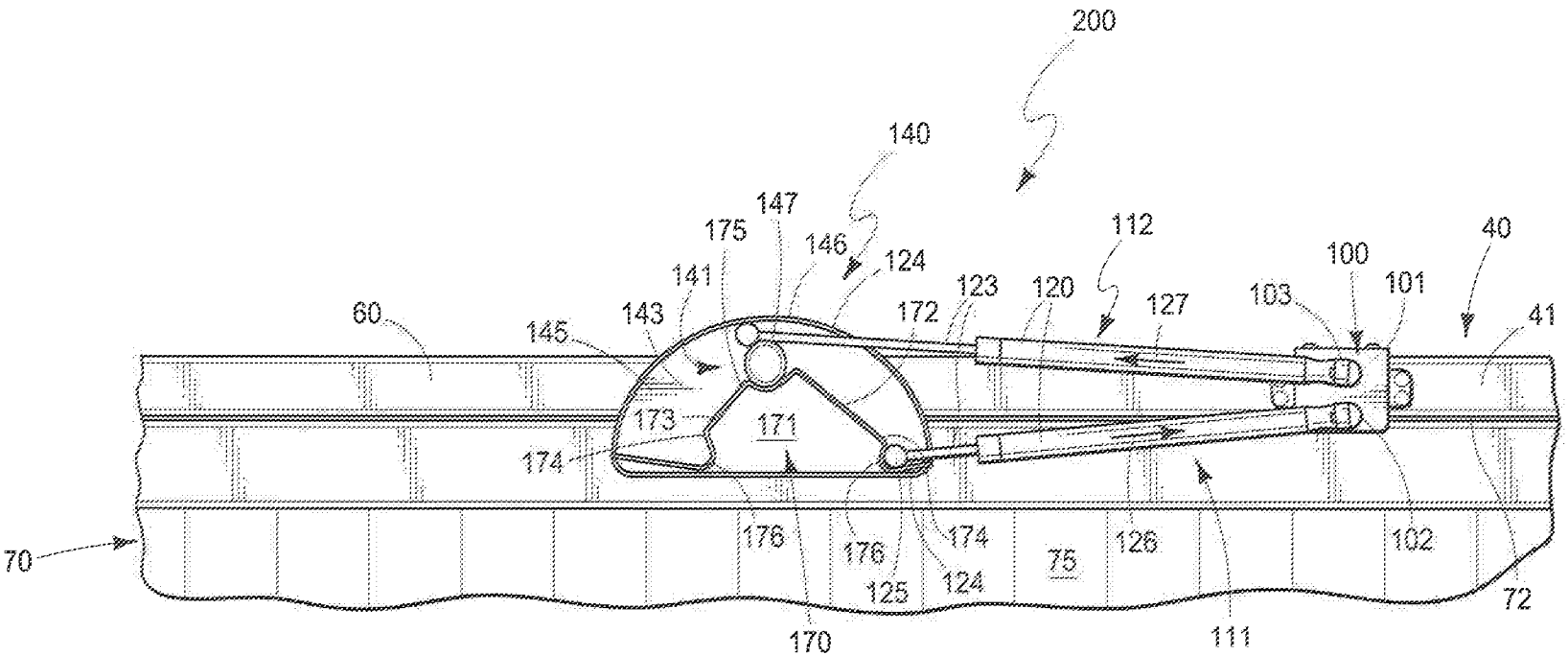
FIG. 5 is a fragmentary, side elevation view of the present invention with a surface removed to show the structure, thereunder.
Figure 5A:
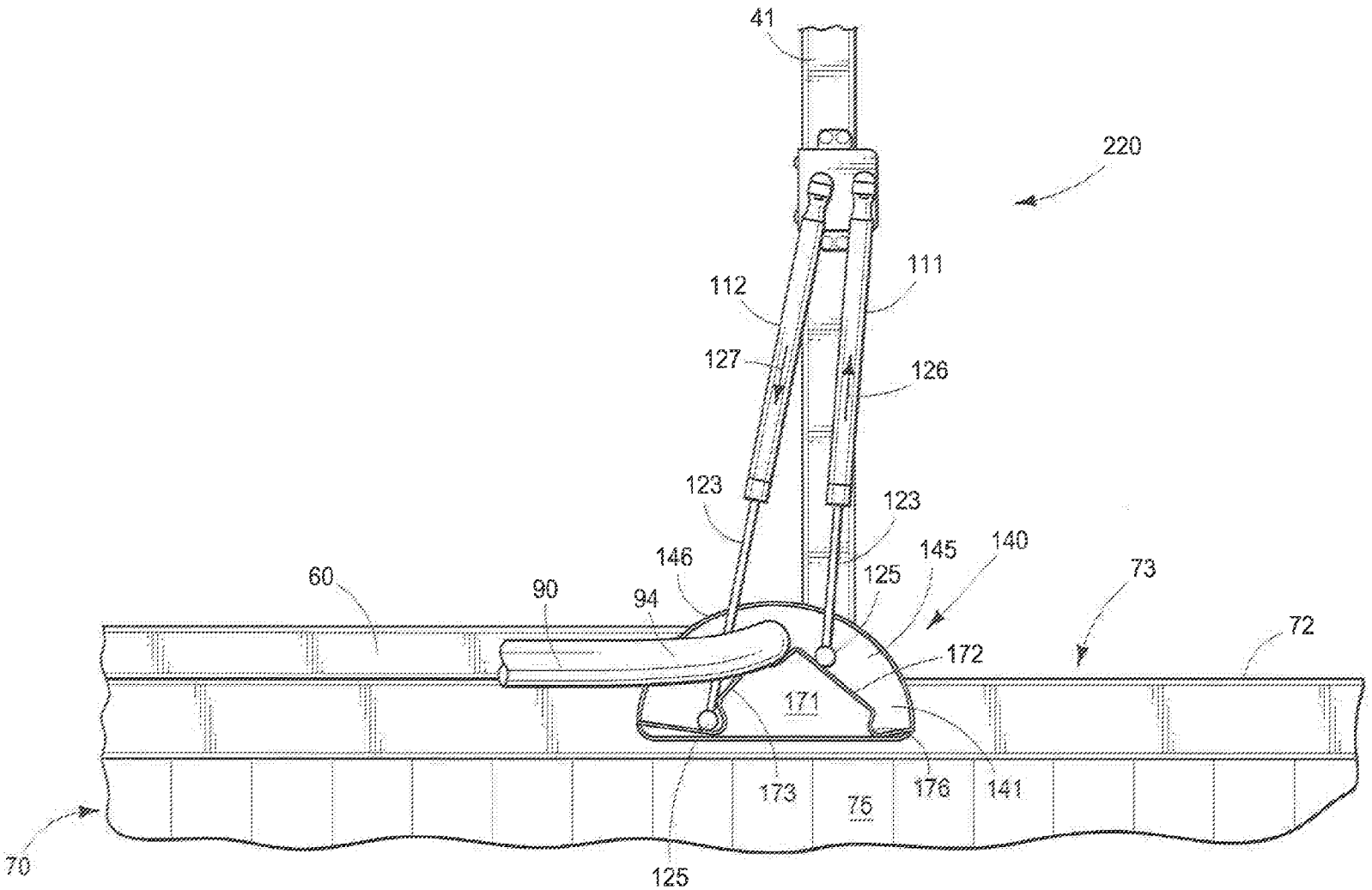
FIG. 5A is a fragmentary, side elevation view showing the operation of the invention when one portion of a spa cover is moved to a substantially vertical orientation.

Referring now to the drawings, and in particular to FIG. 3, and following, the rigid spa cover 40, as employed with the movement assistance device 10 of the prevent invention, includes a lift cross-member which is generally indicated by the numeral 80. The lift cross-member has a main body 81 which has opposite first and second end 82 and 83, respectively. As seen in the drawings, the main body 81 of the lift cross-member 80 is received, at least in part, within the second portion 61 of the spa cover 40. Still further the lift cross-member 80 is located adjacent, and in parallel spaced relation relative to, the continuous joint or hinge 50. Moreover, and as best seen in FIGS. 3 and 5A, the opposite ends 82 and 83 extend, laterally, outwardly relative to the opposite peripheral edges 64 and 65 of the second spa cover portion 60. Additionally, and as seen in the drawings, the invention includes a pair of elongated, lift support arms which are generally indicated by the numeral 90. The respective lift support arms which are designated as a first and second lift support arm 91 and 92, respectively, each has a main body 93 which has a proximal end 94, and which further is attached to one end of the lift cross-member 80; and an opposite distal end 95 which is pivotally mounted on the main body 71 of the spa 70 in the manner which will be discussed in greater detail, below. However, it should be recognized that the lift cross-member 80, and the pair of elongated lift support arms 90, in combination, allow for the selective movement of the first and second portions 41, and 60, of the rigid spa cover 40 about, or relative to, the lift cross-member 80 in a manner so that a user can conveniently move the first and second portions 41 and 60 to a non-occluding position relative to the spa opening 73 as discussed above (FIG. 5D).

Referring now to FIGS. 3 and 5A-5D, the movement assistance device of the present invention 10 includes a pneumatic cylinder mounting fixture which is generally indicated by the numeral 100. The pneumatic cylinder mounting fixture 100 has a main body 101 which is mounted on the opposite first and second peripheral edges 45 and 46, of the first portion 41 of the ridged spa cover 40. As seen in the drawings, the respective pneumatic cylinder mounting fixtures 100 are located in predetermined, spaced relation relative to the rearward peripheral edge 44 of the main body 42. The respective main body 101 of each of the mounting fixtures 100 defines, or otherwise has a first mounting position 102, and a second mounting position 103. The respective mounting positions may be defined by a fixed mounting post, threaded fastener, or other similar mechanical means which is used or employed to rotatably secure another object to same. As seen in the drawings (FIG. 5), the first and second mounting positions 102 and 103 are generally vertically aligned, and are positioned one over the other, and in spaced relation one relative to the other. In the drawings it will be seen that the pneumatic cylinder mounting fixture 100 is operable to mount or secure first and second pneumatic cylinders 111 and 112, respectively, to the first and second mounting positions 102 and 103. In this arrangement the first and second pneumatic cylinders 111 and 112, respectively, are mounted on the opposite peripheral edges 45 and 46 of the first spa cover portion 41, and are operable to assist in the movement of the first spa cover portion 41 relative to the second spa portion 60. This movement of the spa cover 40 will be discussed in greater detail in the paragraphs which follow.

The first and second pneumatic cylinders 111 and 112, respectively, which assist in the movement of the first portion 41 of the ridged spa cover 40 relative to the second portion 60, as will be described, includes a conventional cylinder portion 120 having a proximal end 121, and which is mounted to one of the first or second mounting positions 102 and 103, respectively. When mounted at the first and second position 102 and 103, the cylinder portion 120 has limited rotational movement about a minor arch relative to the first and second mounting positions. The cylinder portion 120 of each of the first and second pneumatic cylinders 111 and 112 has a distal end 122. The cylinder portions 120 are operable to receive and otherwise cooperate with a reciprocally moveable ram portion, and which is generally indicated by the numeral 123. A fluid (not shown) is received within the cylinder portion 123, and allows or facilitates the reciprocal movement of the ram portion 123 in a manner which is well known. The reciprocally moveable ram portion has a distal end 124 which mounts a cylindrically shaped camming member, and which is further generally indicated by the numeral 125. The cylindrically shaped camming member 125 has a circular cross section which allows it to mechanically cooperate, or otherwise seat within a housing which will be discussed in greater detail hereinafter. The reciprocally moveable ram 123 is moveable in a first direction 126 which allows the reciprocally movable ram portion 123 to be received, or retracted, at least in part, within the cylinder portion 127; and a second direction 127 which allows the distal end 124 of the ram to be moved longitudinally outwardly and in an extended orientation, so as to exert force which is applied through the camming member 125 so as to provide the desired movement or resistance to movement, as the situation may be, to the first portion 41 of the spa cover 40, relative to the second portion 60 of the spa cover.

Referring now to FIGS. 3, 5A-5D and 7, the present invention 10 includes a movement assistance housing which is generally indicated by the numeral 140. The housing 140 is defined, in part, by first and second members 141 and 142, respectively and which are mounted in predetermined, spaced relation, one relative to the other. The housing 140, and more specifically the first member 141, thereof, has a main body 143 which has an outwardly facing surface 144, and an opposite inwardly facing surface 145. The main body 143 of the first member 141 has a rounded, upwardly facing peripheral edge 146. Still further, and as seen in the drawings, an aperture 147 is formed in the first member 141, and extends therethrough, and is further sized so as to receive the first and second ends 82 and 83 of the lift cross-member 80 therethrough. As such, the first and second ends 82 and 83 of the lift cross-member extend laterally, outwardly from the inwardly facing surface 145. The main body 143, of the first member 141, is affixed by suitable fasteners to the opposite peripheral edges 64 and 65 of the second portion 60 of the spa cover. As can be seen from the drawings (FIG. 3), first member 141 partially overlaps the opposite peripheral edges 45 and 46 of the first portion 41 of the ridged spa cover 40, but is not affixed to the first portion 41 of the spa cover 40.

The movement assistance housing 140, as noted, above, includes a second member 142 which is mounted in spaced relation relative to the first member 141. In this regard the second member 142 has a main body 150 which has an outwardly facing surface 151, and an opposite, inwardly facing surface 152 which is positioned in spaced relation relative to the first portion 141. The main body 150 of the second portion has an aperture 153 which is formed therein, and which is operable to be substantially, coaxially aligned relative to the aperture 147, and which is formed in the first member 141. It should be understood that the apertures 147 and 153 are sized so as to allow the opposite, first and second ends 82 and 83 of the lift cross-member 80, to extend outwardly relative thereto, and further allows for the proximal ends 94 of the respective lift support arms 90 to be coupled to the first and second ends 82 and 83 of the lift cross-member 80 in a manner which is well known in the arm. As will be recognized from the drawings (FIG. 3), a gap 155 having given dimensions is defined between the spaced first and second member, or portion, 141 and 142, and which forms the movement assistance housing 140, at least in part. This gap 155 is dimensioned so as to allow the distal ends 124 of each of the reciprocally moveable ram portions 123 to pass therethrough, and move therealong the gap in the manner which will be described, below. However, the width dimension of the gap 155 is smaller than either the length dimension, or the cross-sectional dimension of the camming member 125. In this arrangement, the camming member 125 cannot pass out through the gap, but allows the ram 123 to move therealong the gap. The respective rams 123 therefore can only be removed from the assembled housing 140 by the separation of the first and second portions 141 and 142 from each other. When fully assembled, the camming member 125 cannot move out from between the spaced first and second members or portions 141 and 142 respectively.

Figure 5B:
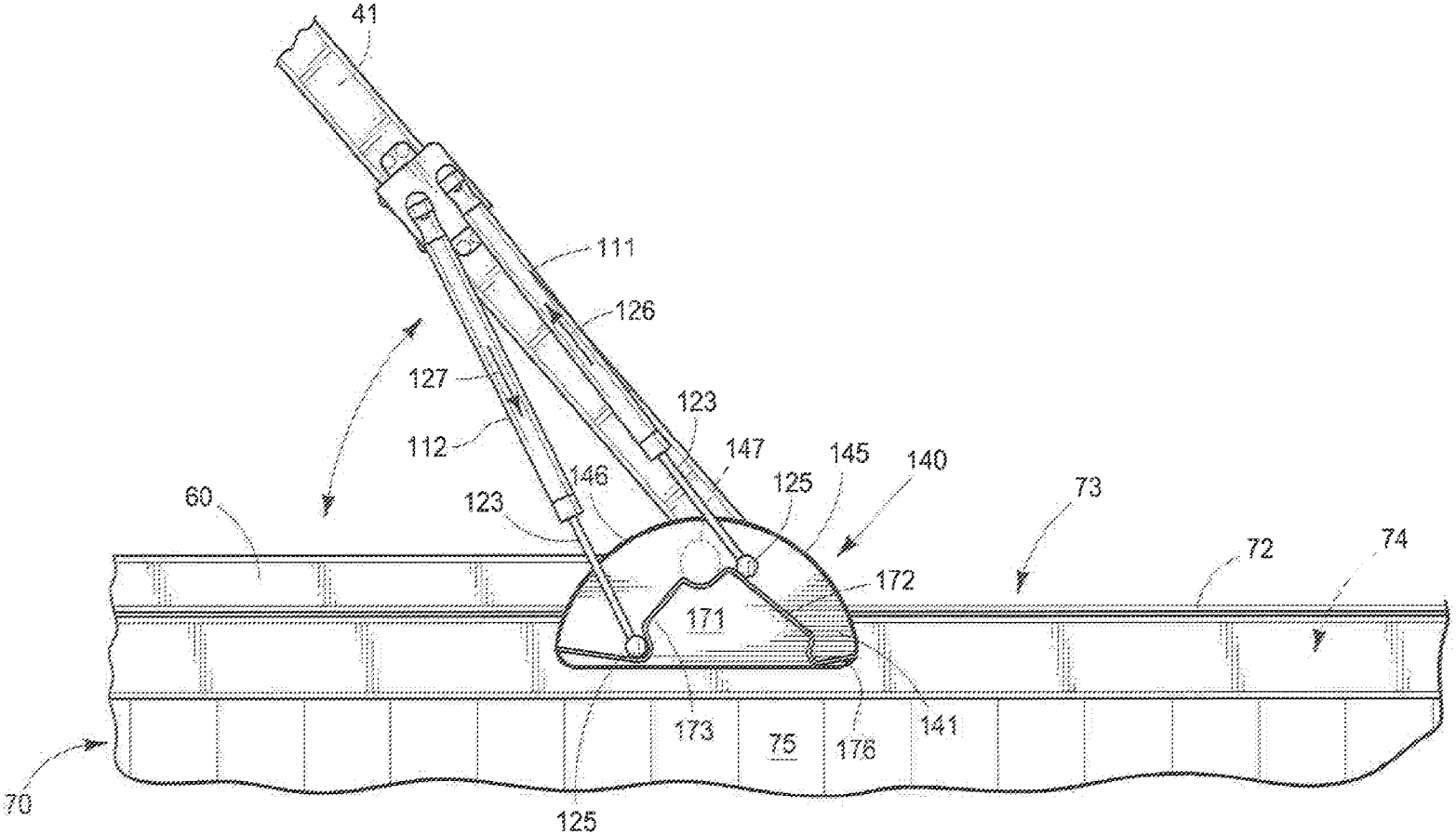
FIG. 5B is a fragmentary, side elevation view showing the operation of the present invention while one portion of a spa cover continues in its movement relative to another portion of the spa cover.
Figure 7:
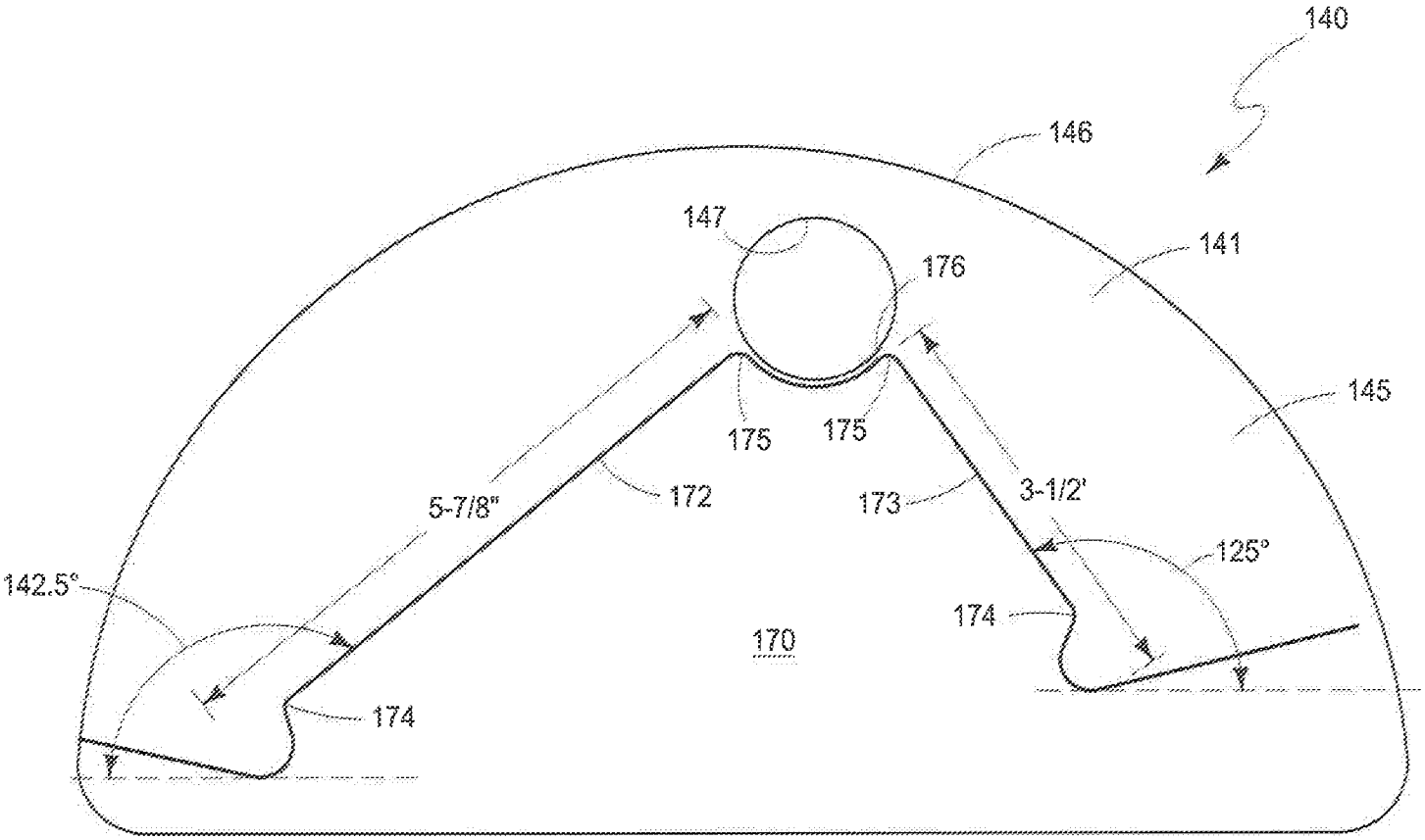
FIG. 7 is a fragmentary, enlarged, side elevation view of a portion of the movement assistance housing of the present invention.

As seen in FIGS. 5A-5D and 7 the second portion 142 of the housing 140 is removed to see the structure, thereunder. As seen in these drawings the movement assistance housing 140 encloses a camming engagement member which is generally indicated by the numeral 170. As will be understood, and seen from the referenced drawings the camming engagement member 170 is illustrated, herein, as being made integral with the inwardly facing surface 145 of the first member 141. However this same structure can be made integral with the inwardly facing surface 152 of the second member 142. As will be understood, the camming engagement member 170 has a predetermined width dimension which functions to space the first and second portions 141 and 142, apart. This width dimension is therefore effective to form the gap 155 as earlier discussed. As will be further appreciated from the disclosure which follows, the operation of the invention 10 will not be effected whether the structure 170 is located on or made integral with the first member or portion of the housing 140, or the second member or portion 142. In this regard, the camming engagement member 170 is generally defined by a truncated shaped main body which is herein indicated by the numeral 171. The truncated shaped main body is defined, in part, by a first camming surface 172, and a second camming surface 173. In the arrangement as seen in the drawings, the reciprocally movable ram portion 123 of the first pneumatic cylinder 111 cooperates with the first camming surface 172, and the reciprocally moveable ram portion 123 of the second pneumatic cylinder 112 cooperates with the second camming surface 173. The respective first and second camming surfaces, 171 and 172, are defined, in part, by a lowermost first end 174, and an opposite, uppermost second end 175. As seen in the drawings a semi-circular shaped cavity or seat 176 is formed in the first end 174 of each of the first and second camming surfaces 172 and 173, respectively (FIGS. 5 and 5B). The respective semi-circular shaped cavities or seats 176 are sized so as to matingly cooperate with the respective camming members 125, and which are mounted on the distal ends 124 of each of the reciprocally moveable ram portions 123. Further, it will be recognized that the camming members 125 are slideably moveable along the first and second ends 174 and 175, respectively (FIGS. 5 and 5A), of each of the camming surfaces 172 and 173 based upon the position or orientation of the first portion 41 of spa cover 40 relative to the second portion 60, as will be discussed below. Referring now to FIG. 7, the first camming surface 172 has an angular inclination of about 142 degrees when that angle is measured from a horizontal plane. Still further, the first camming surface has a length dimension which is greater than the second camming surface 173. Still further the second camming surface 173 has an angular inclination of about 125° when measured from a horizontal plane. In the embodiment as seen in the drawings, the first camming surface has a length dimension of less than about six inches, whereas the second camming surface has a length dimension which is less than about 3.5 inches. As can be seen from the drawings, the aperture 147 passes through the main body 143 of the first member 141 at a location which is between the first and second camming surfaces 172 and 173, respectively.

Figure 4:
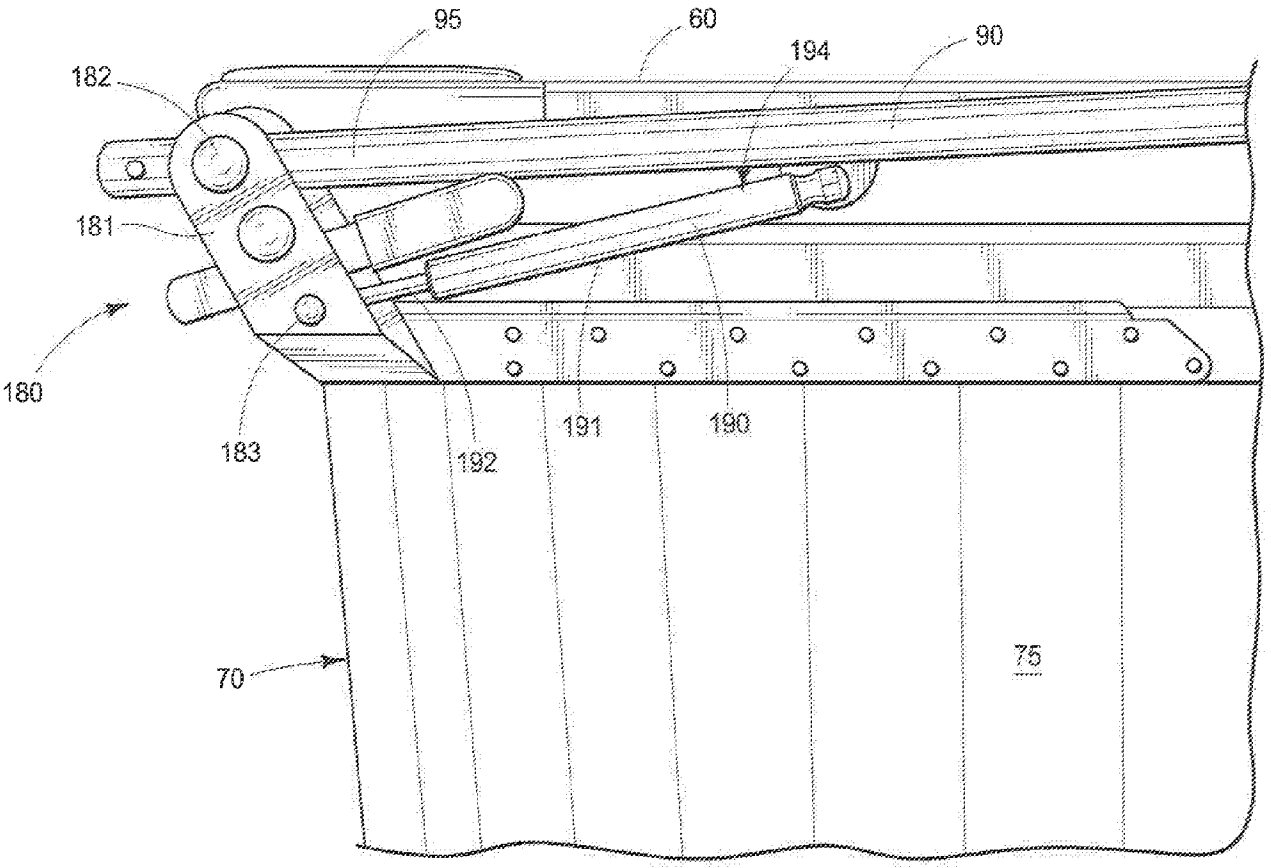
FIG. 4 is a partial, enlarged, side elevation view of a portion of the movement assistance device of the present invention.

Referring now to FIG. 4, the present invention 10 includes a lifting arm support frame which is generally indicated by the numeral 180. The lifting arm support frame has a main body 181 which is affixed to the main body 71 of the spa 70, and is further operable to rotatably cooperate with the distal end 95 of the individual elongated lift support arms 90. In this regard, the main body 181 which is connected or otherwise fastened to the main body of the spa has a first and second pivot point 182 and 183, respectively. The support frame 180 is located endwardly relative to the main body 71 of the spa 70, and below the rearward peripheral edge 63 of the second portion 60 of the spa cover 40. As illustrated in the drawings (FIG. 4) the first pivot point 182 cooperates with the distal end 95 of the respective elongated support members, and the second pivot point 183 mechanically cooperates with a third pneumatic cylinder which is generally indicated by the numeral 190. The third pneumatic cylinder has a cylinder portion 191 which is similar to that described for the first and second pneumatic cylinders 111 and 112, and which is further rotatably secured at a location which is in spaced relation relative to the distal end 95 of the pair of lift support arms 90. The third pneumatic cylinder 190 includes a reciprocally moveable ram 192 which has a distal end 193. The distal end 193 is rotatably coupled to the second pivot point 183 by using a conventional fastener, rod or the like. The reciprocally moveable ram 192 is moveable between a first position 194 (FIG. 4), and wherein the reciprocally moveable ram 192 is operable to exert force which allows or assists in the movement of the first and second portions 41 and 60 respectively of the spa cover 40 to a non-occluded position 202 relative to the spa opening 73 (FIG. 50); and further is moveable to a second position 195, and wherein the reciprocally moveable ram 192 resists the movement of the first and second portions 41 and 60 of the spa cover 40 from a non-occluded position (FIG. 5D) back to a partially occluded position 201 (FIG. 5C) relative to the spa opening. The force exerted by the third pneumatic cylinder 190 substantially reduces the amount of force a user needs to apply so as to effect the movement of the spa cover 40 between the aforementioned orientations, and further prevents damage to the spa, or spa cover which would be occasioned by the rapid acceleration, and impact of these two structures together when moving these structures between these two positions. This movement, and the function of the respective first, second and third pneumatic cylinders 111, 112 and 190, respectively, will be discussed in the paragraphs which immediately follow.

Operation

Figure 5C:
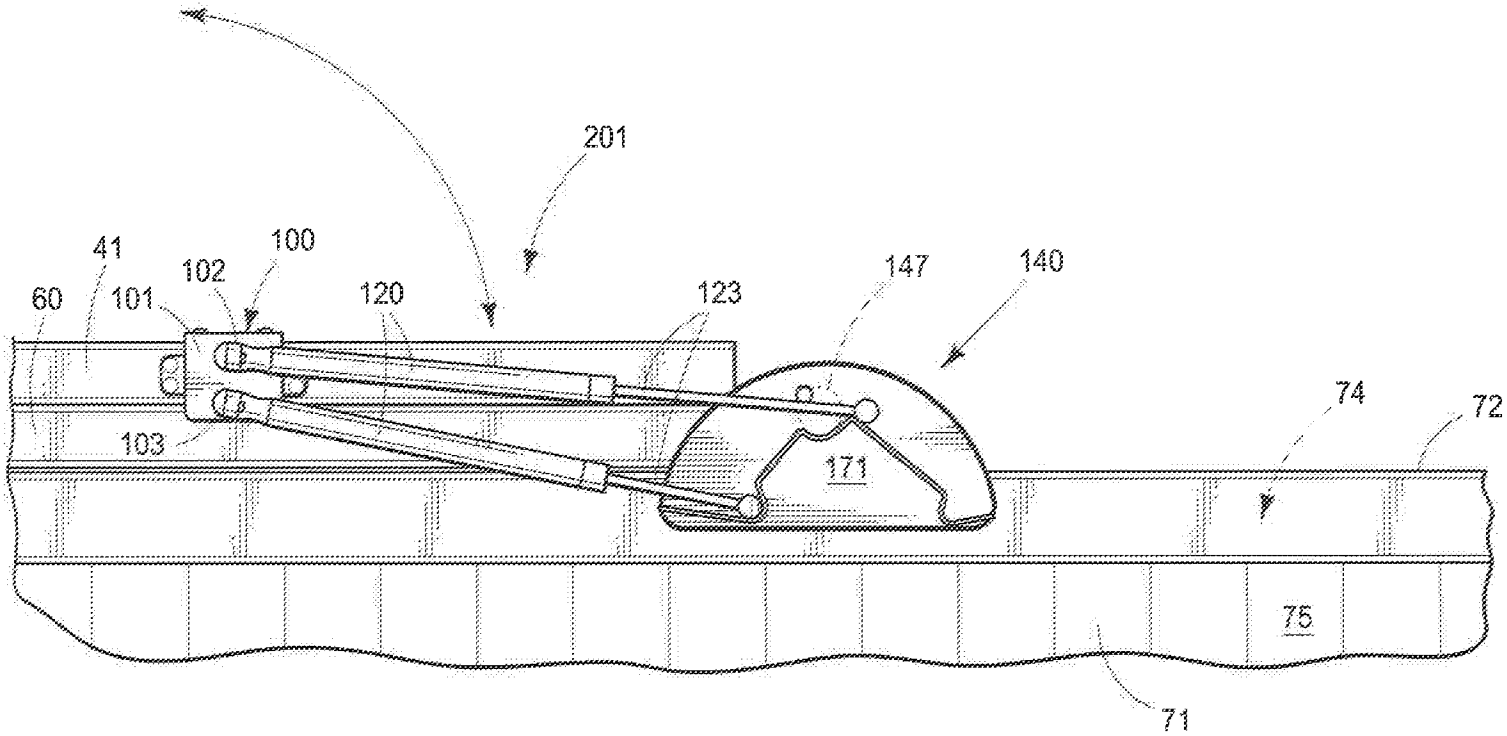
FIG. 5C shows the operation of the present invention at a time subsequent to that as seen in FIG. 5B.

The operation of the described embodiment of the present invention is believed to be readily apparent, and is briefly summarized at this point. In one of its broadest aspects of the present invention relates to a movement assistance device for a spa cover 10, and which includes a spa 70 having a main body 71, and which defines an upwardly facing spa opening 73. The invention 10 further includes a spa cover 40 having first and second portions 41 and 60, respectively, and which are hingedly mounted together, and which further occlude the spa opening 73 when positioned in a co-planar orientation relative to each other. Still further the present invention includes individual lift support arms 90 which cooperate with the second portion 60, of the spa cover 70, and which further have an end 95 which is pivotally attached to the main body 71 of the spa 70. The invention 10, as disclosed, further includes a first and second pneumatic cylinder 111 and 112, respectively, which are mounted on the first portion 41 of the spa cover 40, and which additionally individually, and mechanically cooperate with the second portion 60 of the spa cover 40 so as to assist in the movement of the first portion of the spa cover from the co-planar orientation 200 relative to the second portion 60 of the spa cover 40 (FIG. 3), and which occludes the spa opening 73, to an orientation where the first and second spa cover portions 41 and 60 are located in partially occluding relation 201 relative to the spa opening 73 (FIG. 5C). In the present invention 10 the first and second pneumatic cylinders 111 and 112, respectively, further assist in the return of the first portion 41 of the spa cover 40 back to the co-planar orientation 200 relative to the second portion 60 of the spa cover 40 and which occludes the spa opening 73 as seen in the drawings. A flexible guard 230, is provided, and which encloses the respective pneumatic cylinders 111 and 112, respectively, so as to prevent debris from being deposited on the pneumatic cylinders and further inhibits a user from placing their hand between the pneumatic cylinders while the spa cover 40 is being moved. As seen in FIG. 3, the guard 230 is removed, and shown in a displaced orientation so as to show the structure thereunder. The present invention 10 includes a third pneumatic cylinder 190 which is mounted on the lift support member 90, and which further has a reciprocally moveable ram 192 which is mounted on the main body 71 of the spa 70. The third pneumatic cylinder 190 exerts a force which assists in the movement of the first and second portions 41 and 60 of the spa cover 40 from a partially occluding position 201 (FIG. 5C) relative to the spa opening 70, to a non-occluding position 202 (FIG. 5D), and further resists the movement of the first and second portions 41 and 60 of the spa cover 40 from the non-occluding position 202 relative to the spa opening 73 to a partially occluding position 201 relative to the spa opening 73 (FIG. 5C).

The present invention 10 includes a lift cross-member 80 having opposite ends 82 and 83. As seen in the drawings (FIG. 3) at least a portion of the lift cross-member 80 cooperates with a second portion 60 of the spa cover 40, and the opposite ends 82 and 83 thereof extend laterally, outwardly relative to the second portion of the spa cover 40. The present invention 10 further includes at least one lift support arm 90 which has a proximal end 94, and which further is coupled to one end of the lift cross-member 80; and a distal end 95 which is pivotally mounted to the main body 71 of the spa 70 (FIG. 4). In the arrangement as seen in the drawings the invention 10 further includes a support frame 180 for receiving the distal end 95 of the lift support arm 90, and which is further mounted on the main body 71 of the spa 70. The support frame 180 has a main body 181 which has a first pivot point 182 upon which the distal end 195 of the lift support arm 90 is pivotally coupled. The support frame 180 further defines a second pivot point 183 upon which the reciprocally moveable ram 192 is rotatably coupled.

The movement assistance device 10 of the present invention further includes a housing 140 having first and second members or portions 141 and 142, respectively, and which are located in spaced relation one relative to the other. The housing 140 is mounted on opposite peripheral edges 64 and 65 respectively of the second portion 60 of the spa cover 40. A ramming engagement member 170 is positioned between the first and second members 141 and 142, and within the housing 140. Each of the first and second pneumatic cylinders 111 and 112, respectively, have a reciprocally moveable ram 123, with a distal end 124. A ramming member 125 is mounted on each distal end 124 of the respective moveable rams 123, and is operable to cooperate with the ramming engagement member 170, as previously described. In this regard the camming engagement member 170 (FIG. 7) is generally truncated in shape, and is defined, in part, by first and second ramming surfaces 172 and 173, respectively. The first ramming surface 172 has an angular inclination of about 142° when measured from a horizontal plane. The second ramming surface 173 has an angular inclination of about 125° when measured from a horizontal plane. The first ramming surface 172 has a length dimension which is greater than the second ramming surface 173. Still further a semi-circular shaped cavity or seat 176 is formed in one end of each of the first and second ramming surfaces 172 and 173, respectively, and which is further operable to matingly cooperate with the ramming member 125 which is mounted on the distal end 124 of each of the reciprocally moveable rams 123, of the first and second pneumatic cylinders 111 and 112 as previously described. In the arrangement as seen in the drawings, the distal end 124 of the moveable ram 123, and which forms a portion of the first pneumatic cylinder 111, cooperates with the first camming surface 172, as defined by the camming engagement member 170, and the distal end 124 of the moveable ram 123, and which forms a portion of the second pneumatic cylinder 112 cooperates with the second camming surface 173 of the camming member 170. In the arrangement as seen in the drawings the camming engagement member 170 can be made integral with either the first member or portion 141 of the housing 140, or the second member or portion 142.

Figure 5D:
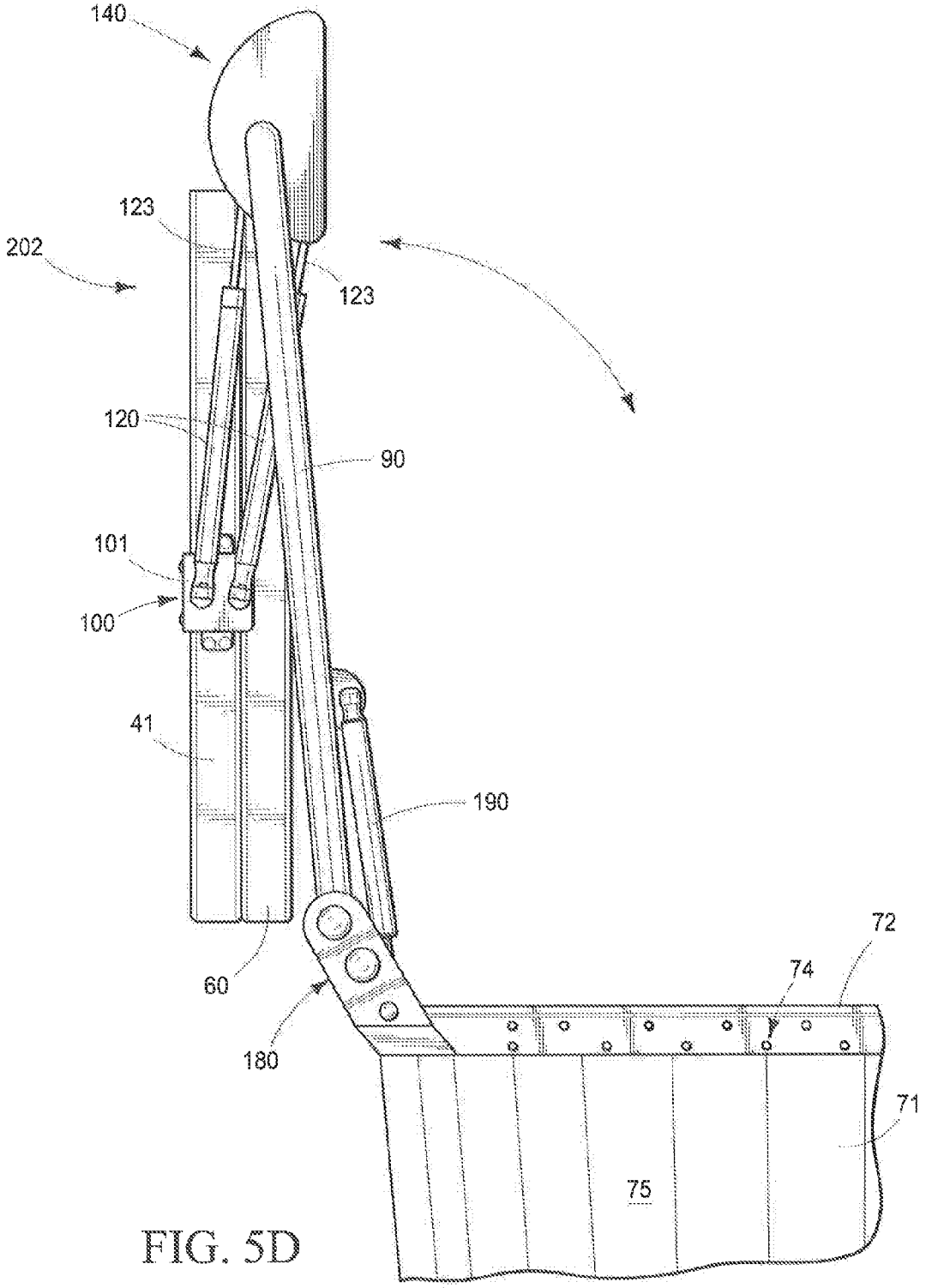
FIG. 5D shows the operation of the present invention at a time subsequent to that as seen in FIG. 50.
Figure 6A:
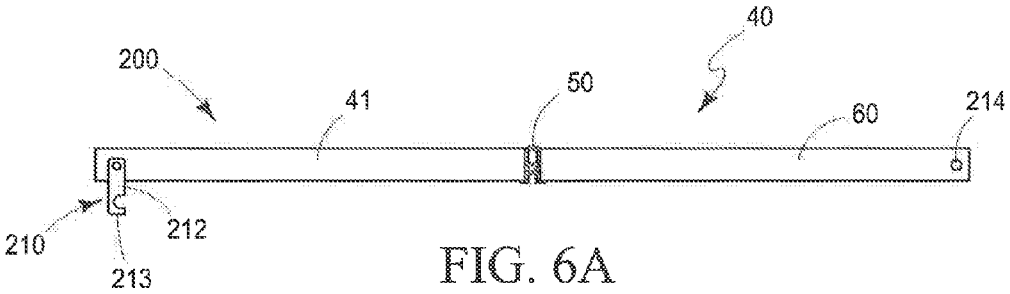
FIG. 6A shows another feature of the present invention when the spa cover is located in a first position.
Figure 6B:
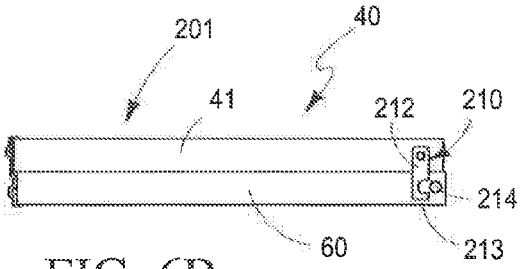
FIG. 6B is a side elevation view of the invention feature as seen in FIG. 6A, and which illustrates the operation of same when the spa cover is located in a second position.
Figure 6C:
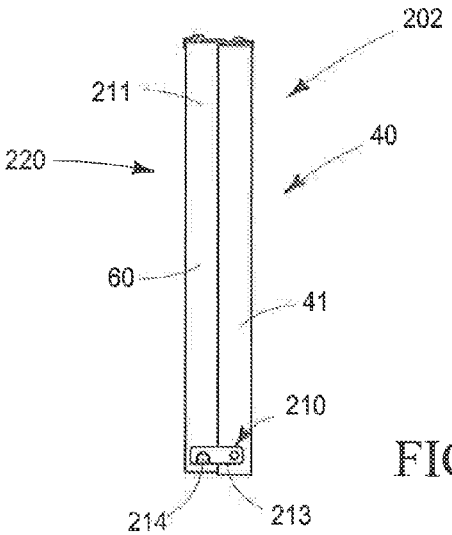
FIG. 6C is a side elevation view of the invention feature as seen in FIG. 6A, and which illustrates the operation of same when the spa cover is located in a third position.

In one form of the invention, the present invention (FIGS. 6A-6C) includes a locking member 210 which releasably couples the first and second portions 40 and 61 of the spa cover 40, together, when the first and second portions of the spa cover are located in a vertical orientation 211 (FIG. 5D) and in a non-occluding position 202 relative to the spa opening 73. In this regard the locking member 210 automatically releases the first and second portions 41 and 60 of the spa cover 40 from the other, when the first and second portions 41 and 60 respectively of the spa cover 40 are located in a horizontal position, and in a partially occluding orientation 201 relative to the spa opening 73 (FIG. 6B). The locking member 210 includes a main body 212 which has an engagement end 213 which is sized so as to releasably engage an off-set post 214 which is mounted on the adjacent spa cover portion. It should be understood that in the juxtaposed, horizontal orientation (FIG. 6B) the locking member 210 swings, by the force of gravity, to a position where it does not engage the off-set post 214 which is on the adjacent spa cover portion. However, when the first and second spa cover portions 41 and 60, respectively, are located in a vertical orientation 211 and in the non-occluding position 202 as seen in FIG. 6C, the locking member 210, under the influence of gravity, moves into engagement with the off-set post 214 so as to prevent the first and second portions 41 and 60, from separating one from the other. This provides increased safety when moving the spa cover between the orientations discussed, above.

The movement assistance device for a spa cover of the present invention 10 operates in a novel manner. In this regard, the first spa cover portion 41 hingedly moves, at least in part, under the influence of a user relative to the second spa cover portion 60. When a user exerts force to open the spa cover 40 they would typically apply physical force upwardly on the first spa cover portion 41. Upon applying upward physical force, the first pneumatic cylinder 111 exerts additional or supplemental pneumatic force to assist in the movement of the spa cover portion 41 from a co-planar orientation 200 relative to the spa cover portions 60 (FIG. 5) to an orientation where the first spa cover portion 41 is oriented substantially perpendicular or vertically 220 relative to the second spa cover portion 60 (FIG. 5A). This additional, forcible assistance provided by the first pneumatic cylinder 111 occurs when the camming member 125 seats within the similarly, circular shaped cavity 176 which is located at the first end of the 174 of the first camming surface 172. Once the first spa cover portion 41 reaches the vertical orientation 220, and begins to move downwardly towards the second portion 60 (FIG. 5B), the second pneumatic cylinder 112 forcibly resists the movement of the first cover portion 41 from the vertical orientation 220, to where it comes into contact with the second spa cover portion 60 (FIG. 5C). As seen in FIG. 5B the camming member 125 seats in the semi-circular cavity 176 which is formed in the second camming surface 173 during this movement. In this orientation, 201, the first cover portion 41 is located in a horizontal, juxtaposed, and parallel orientation relative to the second spa cover portion 61, and is further located in a partially occluding position 201 relative to the spa opening 73. Conversely, and when the user wishes to close the spa cover 40, and the first and second spa cover portions 41 and 60 are in the partially occluding position 201, any upwardly directed force applied by a user to the first portion of the spa cover 41 allows the second pneumatic cylinder 112 to exert additional force on the first spa cover portion 41, so as to assist in the movement of the first spa cover portion 41 from the horizontal, juxtaposed, and parallel orientation 201 relative to the second spa portion 60, back to the vertical orientation 220. Once the first spa cover portion 41 begins to move downwardly towards the co-planar orientation 200, the first pneumatic cylinder 111 resists the movement of the first spa cover portion 41 from the vertical orientation to the co-planar orientation 200 where the first spa cover portion 41 is located horizontally, and in an occluding position relative to the spa opening 73 (FIG. 5). Once the first and second portions of the spa cover 41 and 60 are in the juxtaposed, substantially parallel relationship, and in partially occluding relation 201 relative to the spa opening 73 (FIG. 5C), the user may, by applying physical force which is directed upwardly relative to both the first and second portions 41 and 60, move the first and second portions 41 and 60 to a non-occluding position 202 (FIG. 5D). The user is assisted in this movement by the third pneumatic cylinder 190. In this regard the third pneumatic cylinder 190 exerts a force to assist in the movement of the first and second spa cover portions 41 and 60, in unison, from the horizontal, partially occluding orientation 201 relative to the main body 71 of the spa 70, to the vertically, non-occluding position 202 which exposes the spa opening 73 (FIG. 5D). Still further, the third pneumatic cylinder 190 further resists the movement of the first and second portions of the spa cover 41 and 60 from the vertical non-occluding position 202 relative to the spa opening 73 (FIG. 5D) back in the direction toward the horizontal, partially occluding orientation 201 relative to the spa opening 73 (FIG. 5C). As described above, the second pneumatic cylinder 112 then assists the user in moving the first portion of the spa cover 41 back to a co-planar orientation 200 such that the spa opening 73 is completely occluded (FIG. 5).

Therefore, it will be seen that the present invention 10 provides a convenient means whereby a user, with the exertion of minimal physical force or energy may open a spa cover 40 in an easy and simple (EAS) manner not possible, heretofore. The present invention 10 is rather simple in its construction, controls the movement of the portions of the spa cover 41 and 60, and further prevents the spa cover portions from moving in an uncontrollable fashion so as to avoid damage to either the spa or spa cover, or harm to the user. The present invention further inhibits a user from struggling to open either a large spa cover, or one that might be covered with snow or ice. As should be understood, the present invention could further include selectively actuatable air cylinders which would be used in place of the pneumatic cylinders as previously described. In this alternative embodiment (not shown) a small air compressor would be selectively coupled to the respective air cylinders, and an electric controller would selectively control the delivery of the compressed air to the respective air cylinders in a controlled manner so as to effect the opening and closing of the spa cover 40.

In compliance with the statute the invention has been described in language more or less specific as to structural and methodical features. It is to be understood, however, that the invention is not limited to the specific features shown or described since the means herein disclose comprised preferred forms of putting the invention into effect. The invention is therefore claim in any of its forms or modifications, within the proper scope of the appended claims, appropriately interpreted in accordance with the doctrine of equivalence.

I claim:

1. A movement assistance device for a spa cover, comprising:

a spa having a main body and which defines an upwardly facing spa opening;

a spa cover having first and second portions which are hingedly mounted together and which occlude the spa opening when positioned in a coplanar orientation relative to each other;

individual lift support arms cooperating with the second portion of the spa cover, and which further have an end which is pivotally attached to the main body of the spa;

a first and second pneumatic cylinder which are mounted on the first portion of the spa cover, and which individually, and mechanically cooperate with the second portion of the spa cover to assist in the movement of the first portion of the spa cover from a coplanar orientation relative to the second portion of the spa cover, and which occludes the spa opening, to an orientation where the first and second spa cover portions are located in a partially occluding position relative to the spa opening, and wherein the first and second pneumatic cylinders further assist in the return of the first portion of the spa cover back to the coplanar orientation relative to the second portion of the spa cover and which occludes the spa opening; and a third pneumatic cylinder mounted on the lift support member and which has a reciprocally moveable ram which is mounted on the main body of the spa, and wherein the third pneumatic cylinder exerts a force which assists in the movement of the first and second portions of the spa cover from a partially occluding position relative to the spa opening, to a non-occluding position relative the spa opening, and further resists the movement of the first and second portions of the spa cover from the non-occluding position relative to the spa opening to a partially occluding position relative to the spa opening.

2. A movement assistance device as claimed in claim 1, and further comprising:

a lift cross-member having opposite ends, and wherein at least a portion of the lift cross-member cooperates with the second portion of the spa cover, and the opposite ends of the lift cross-member extend laterally outwardly relative to the second portion of the spa cover.

3. A movement assistance device as claimed in claim 2, and wherein the lift support arm has a proximal end which is coupled to one end of the lift cross-member, and a distal end which is pivotally mounted to the main body of the spa.

4. A movement assistance device as claimed in claim 3, and wherein a support frame for receiving the distal end of the lift support arm is mounted on the main body of the spa, and further has a first pivot point upon which the distal end of the lift support arm is pivotally coupled, and wherein the support frame further defines a second pivot point upon which the reciprocally moveable ram is rotatably coupled.

5. A movement assistance device as claimed in claim 4, and further comprising:

a housing having first and second members which are located in spaced relation one relative to the other, and wherein the housing is mounted on a peripheral edge of the second portion of the spa cover, and wherein a camming engagement member is positioned between the first and second members, and within the housing, and wherein each of the first and second pneumatic cylinders have a reciprocally moveable ram with a distal end, and wherein a camming member is mounted on each distal end of the respective moveable rams.

6. A movement assistance device as claimed in claim 5, and wherein the camming engagement member s generally truncated in shape and is defined, in part, by first and second camming surfaces, and wherein the first camming surface has an angular inclination of about 142 degrees when measure from a horizontal plane, and the second camming surface has an angular inclination of about 125 degrees when measured from a horizontal plane, and wherein the first camming surface has a length dimension which is greater than a length dimension of the second camming surface, and wherein a semi-circular shaped cavity is formed in one end of each of the first and second camming surface, and which is further operable to matingly cooperate with the camming member which is mounted on the distal end of each of the reciprocally moveable rams of the first and second pneumatic cylinders.

7. A movement assistance device as claimed in claim 6, and wherein the distal end of the moveable ram of the first pneumatic cylinder moveably and forcibly cooperates with the first camming surface of the camming engagement member, and the distal end of the second moveable ram moveably and forcibly cooperates with the second camming surface of the camming member.

8. A movement assistance device as claimed in claim 7, and wherein the housing is defined, in part, by a first member which is mounted on the peripheral edge of the second portion of the spa cover, and wherein the first member further defines an aperture which is sized so that the end of the lift cross-member extends through, and laterally outwardly therefrom, and wherein the housing further has a second portion which is located in spaced relation relative to the first portion, and the camming engagement member is located between the first and second members, and within the housing, and wherein a gap is defined between the first and second portions of the housing, and the distal end of the respective rams extend through the gap.

9. A movement assistance device as claimed in claim 8, and wherein the camming engagement member is made integral with the first member, and the aperture is located between the first and second camming surfaces which are defined by the camming engagement member.

10. A movement assistance device as claim in claim 8, and wherein the camming engagement member is made integral with the second member.

11. A movement assistance device as claimed in claim 8, and further comprising a guard overlying, and enclosing, at least in part, the first and second pneumatic cylinders.

12. A movement assistance device as claimed in claim 8, and further comprising a locking member which releasably couples the first and second portions of the spa top together when the first and second portions of the spa top are located in a vertical orientation and in a non-occluding position relative to the spa opening, and wherein the locking member automatically releases the first and second portions of the spa top, one from the other when the first and second portions of the spa top are located in an horizontal position, one relative to the other.

13. A movement assistance device for a spa cover, comprising:

a spa having a main body, and defining an upwardly facing spa opening;

a spa cover having first and second portions, and which are operable, when located in a coplanar orientation relative to each other to substantially occlude the spa opening, and wherein the first and second spa cover portions are hingedly mounted together;

a lift cross-member having opposite ends, and wherein at least a portion of the lift cross member cooperates with the second portion of the spa cover;

individual lift support arms which are mounted to the opposite ends of the lift cross-member, and wherein an end of each of the lift support members is pivotally mounted to the main body of the spa;

a housing having first and second members which are located in spaced relation one relative to the other, and wherein the housing is mounted on the second portion of the spa cover, and wherein a camming engagement member is positioned between the first and second members and within the housing;

a first and second pneumatic cylinder mounted on the first portion of the spa cover, and wherein the pneumatic cylinder has a reciprocally moveable ram portion which has a distal camming member which cooperates with the camming engagement member, and wherein the first pneumatic cylinder exerts a force which assists in the movement of the first portion of the spa cover from a co-planar orientation relative to the second portion of the spa cover to a vertical orientation relative to the second portion of the spa cover, and further the first pneumatic cylinder resists the movement of the first portion of the spa cover from the vertical orientation relative to the second portion of the spa cover back to the co-planar orientation relative to the second portion of the spa cover, and wherein the second pneumatic cylinder resist the movement of the first portion of the spa cover from the vertical orientation relative to the second portion of the spa cover, to a juxtaposed, substantially parallel orientation relative to the second portion of the spa cover, and where the spa opening is partially non-occluded; and a third pneumatic cylinder mounted on the lift support arm and which has a reciprocally moveable ram member which is attached to the main body of the spa, and wherein the third pneumatic member exerts a force to assist in the movement of the first and second spa cover portions from a partially occluding orientation relative to the spa opening, to a non-occluding orientation relative thereto, and further resists the movement of the first and second spa cover portions from the non-occluding orientation relative to the spa opening back to a partially occluding orientation relative to the spa opening.

14. A movement assistance device as claimed in claim 13, and wherein a support frame for pivotally cooperating with the lift support arm is mounted on the main body of the spa, and further has a first pivot point upon which the lift support arm is pivotally coupled, and wherein the support frame further defines a second pivot point upon which the reciprocally moveable ram portion of the third pneumatic cylinder is rotatably coupled.

15. A movement assistance device as claimed in claim 14, and wherein the housing is mounted on a peripheral edge of the second portion of the spa cover, and wherein the camming engagement member is generally truncated in shape, and is defined, in part, by first and second caroming surfaces, and wherein the first camming surface has an angular inclination of about 142 degrees when measured from a horizontal plane, and the second camming surface has an angular inclination of about 125 degrees when measured from a horizontal plane, and wherein the first camming surface has a length dimension which is greater than a length dimension of the second camming surface, and wherein a semi-circular shaped cavity is formed in one end of each of the first and second camming surfaces, and which is further operable to matingly cooperate with the camming member which is mounted on the distal end of each of the reciprocally moveable rams of the first and second pneumatic cylinders.

16. A movement assistance device as claimed in claim 15, and wherein the distal end of the moveable ram of the first pneumatic cylinder cooperates with the first camming surface of the camming engagement member, and the distal end of the second moveable ram cooperates with the second camming surface of the camming member, and wherein, during the movement of the first and second portions of the spa cover, the camming member mounted on the distal end of the respective ram portions matingly seats, and then unseats from the semi-circular shaped cavity which is formed in the first and second camming surfaces of the camming engagement member.

17. A movement assistance device as claimed in claim 16, and wherein the first and second members of the housing further define a pair of coaxially aligned apertures which are sized so that the end of the lift cross-member extends therethrough, and laterally, outwardly therefrom, and the first and second portions of the housing define a gap, and through which the respective ram portions extend, and is then located between the first and second portions of the housing, and wherein the camming member mounted on the respective ram portions is sized so that it cannot be removed from between the first and second portions of the housing, and through the gap, when the housing is assembled.

18. A movement assistance device as claimed in claim 17, and wherein the camming engagement member is made integral with the first member of the housing, and the aperture is located between the first and second camming surfaces which are defined by the camming engagement member.

19. A movement assistance device as claim in claim 18, and wherein the camming engagement member is made integral with the second member.

20. A movement assistance device for a spa cover, comprising:

a spa having a main body which defines an internal cavity, and which encloses a source of water, and wherein the spa has top peripheral edge which defines a spa opening, and further which allows access to the spa by a user;

a spa cover having first and second spa cover portions which are hingedly mounted together at a continuous joint, and wherein the first and second spa cover portions when oriented in a coplanar orientation relative to each other, and are further in rested relation relative to the top peripheral edge of the spa, are sized so as to occlude the spa opening defined by the top peripheral edge of the spa, and wherein each of the first and second spa cover portions have opposite peripheral edges;

a lift cross-member having a main body and opposite ends, and wherein the main body of the lift cross-member is received, at least in part, within the second portion of the spa cover, and is further located adjacent, and in parallel relation relative to the continuous joint, and wherein the opposite ends of the lift cross-member extend laterally, outwardly, relative to the opposite peripheral edges of the second spa cover portion;

a pair of elongated, lift support arms which are individually attached to the opposite ends of the lift cross-member, and wherein the respective lift support arms each have a proximal end which is attached to one end of the lift cross member, and a distal end which is pivotally mounted on the main body of the spa;

a first and second pneumatic cylinder mounted on the opposite peripheral edges of the first spa cover portion, and wherein the respective pneumatic cylinders have a cylinder portion which is pivotally attached to the opposite peripheral edges of the first spa cover portion, and a reciprocally moveable ram portion which cooperates with the cylinder portion, and which further has a distal end which mounts a camming member thereon, and wherein the reciprocal movement of the ram portion, in a first direction and towards the cylinder portion, is forcibly resisted by the action of the cylinder portion, and the reciprocal movement of the ram portion, in an opposite, second direction and away from the cylinder portion exerts a longitudinally, outwardly directed force;

a housing mounted on each of the opposite, peripheral edges of the second spa cover portion, and wherein the housing has a first member mounted on the opposite, peripheral edges of each of the second spa cover portion, and which further has a passageway formed therein, and which is sized so as to permit the opposite ends of the lift cross-member to extend laterally, outwardly therethrough, and a second member is mounted to the first member, and which is further oriented in spaced relation relative thereto, and wherein a camming engagement member is positioned therebetween the first and second members of the housing, and the camming members of the first and second pneumatic cylinders are received within each of the housings, and moveably engage the camming engagement member when the first spa cover portion hingedly moves relative to the second spa cover portion, and wherein first pneumatic cylinder exerts force to assist in the movement of the first spa cover portion from a coplanar orientation relative to the second spa cover portion to an orientation where the first spa cover portion is oriented substantially perpendicular relative to the second spa cover portion, and wherein the second pneumatic cylinder forcibly resists the movement of the first cover portion from a substantially vertical orientation relative to the second spa cover portion, to a horizontal, juxtaposed, and parallel orientation relative to the second spa cover portion, and wherein the second pneumatic cylinder exerts force on the first spa cover portion to assist in the movement of the first spa cover portion from the horizontal, juxtaposed, and parallel orientation relative to the second spa portion, to a vertical orientation relative to the second spa portion, and the first pneumatic cylinder resists the movement of the first spa cover portion from the vertical orientation relative to the second spa cover portion, to an orientation where the first spa cover portion is located in a coplanar orientation relative to the second spa cover portion; and a third pneumatic cylinder having a cylinder portion which is mounted on each of the lift support members, and which further has a reciprocally moveable ram portion which cooperates with the cylinder portion thereof, and which further has a distal end which is pivotally attached to the main body of the spa, and wherein the third pneumatic cylinder exerts a force to assist in the movement of the first and second spa cover portions from a horizontal, partially occluding orientation relative to the main body of the spa to a vertical, non-occluding orientation which exposes the spa opening, and wherein the third pneumatic cylinder further resists the movement of the first and second portions of the spa cover from the vertical, non-occluding orientation relative to the spa opening, to the horizontal, partially occluding orientation relative to the spa opening.

* * * * *